US005149101A

United States Patent [19]

Mazza et al.

[11] Patent Number: 5,149,101

[45] Date of Patent: Sep. 22, 1992

[54] HORSE RACE GAME APPARATUS

[76] Inventors: Peter A. Mazza, Rte. 6, Box 526, Dahlonega, Ga. 30533; Jasper Kirk, 235 Valley Dr., Roswell, Ga. 30075

[21] Appl. No.: 797,369

[22] Filed: Nov. 25, 1991

[51] Int. Cl.[5] ..... A63F 3/00; A63F 9/14

[52] U.S. Cl. ..... 273/246; 273/86 A; 273/291

[58] Field of Search ..... 273/246, 86 A, 86 R, 273/86 D, 291

[56] References Cited

U.S. PATENT DOCUMENTS

| | | | |
|---|---|---|---|
| 1,444,772 | 2/1923 | Bedaux | 273/86 D |
| 2,629,602 | 2/1953 | Bach et al. | 273/246 |
| 2,814,492 | 11/1957 | Mohlenbrock | 273/86 C |
| 2,823,919 | 2/1958 | Scruggs | 273/246 |

FOREIGN PATENT DOCUMENTS

| | | | |
|---|---|---|---|
| 470716 | 8/1937 | United Kingdom | 273/86 C |
| 841727 | 7/1960 | United Kingdom | 273/246 |

*Primary Examiner*—Benjamin Layno

*Attorney, Agent, or Firm*—Leon Gilden

[57] ABSTRACT

A horse game apparatus includes a game board formed with spaced game path spaces initiating a race from a first end to a second end of the game board, wherein a predetermined number of tokens are associated with a predetermined number of dice and to include wagering tokens, as well as run-off tokens, whereupon a roll of the predetermined number of dice permits movement of a token, with each token designated an indicia number of the dice, wherein each dice includes indicia including each number such as the numbers 1-6 of a conventional die member.

1 Claim, 4 Drawing Sheets

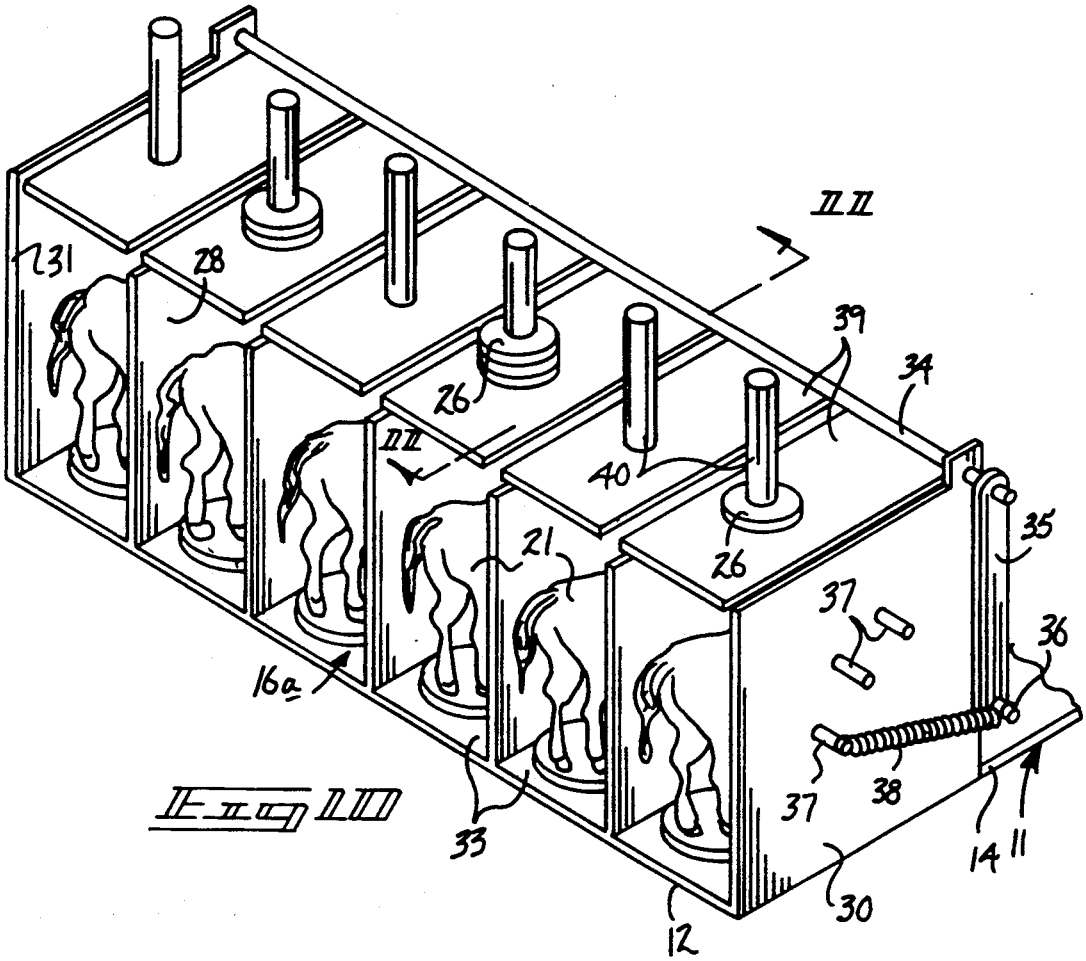
Fig III
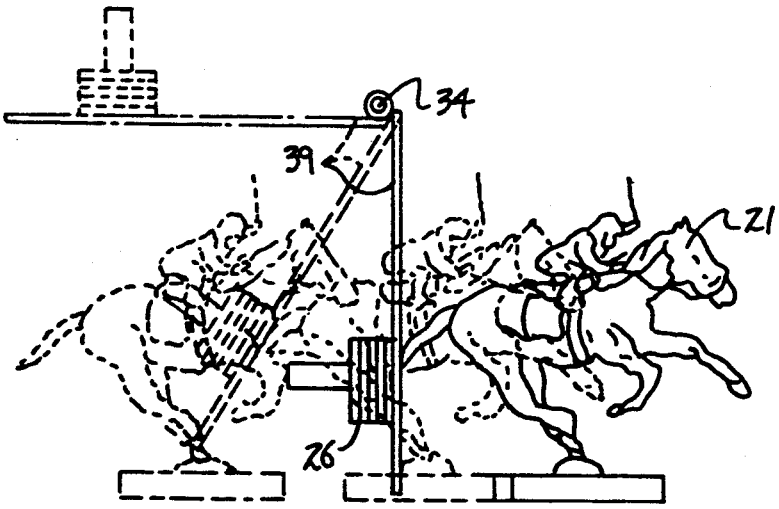
Fig II

HORSE RACE GAME APPARATUS

BACKGROUND OF THE INVENTION

1. Field of the Invention

The field of invention relates to game apparatus, and more particularly pertains to a new and improved horse race game apparatus wherein the same is arranged for simulation of wagering thereof.

2. Description of the Prior Art

Games and horse race games in particularly have been utilized throughout the prior art for the entertainment and amusement of individuals. Such apparatus is exemplified in U.S. Pat. No. 4,955,617 to Mason, Jr., et al.; U.S. Pat. No. 4,881,740 to Odhner; and U.S. Pat. No. 4,966,371. A horse race game structure is set forth in U.S. Pat. No. 4,629,568 to Welsh utilizing various chips to associate wagering in a horse racing event.

As such, it may be appreciated that there continues to be a need for a new and improved horse race game apparatus as set forth by the instant invention which addresses both the problems of each of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a horse race game apparatus wherein the same is arranged for the simulation of a horse racing event. As such, the general purpose of the present invention, which will be described subsequently in greater detail, is to provide a new and improved horse race game apparatus which has all the advantages of the prior art game apparatus and none of the disadvantages.

To attain this, the present invention provides a horse game apparatus including a game board formed with spaced path spaces initiating a race from a first end to a second end of the game board, wherein a predetermined number of tokens are associated with a predetermined number of dice and to include wagering tokens, as well as run-off tokens, whereupon a roll of the predetermined number of dice permits movement of a token, with each token designated an indicia number of the dice, wherein each dice includes indicia including each number such as the numbers 1-6 of a conventional die member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved horse race game apparatus which has all the advantages of the prior art game apparatus and none of the disadvantages.

It is another object of the present invention to provide a new and improved horse race game apparatus which may be easily and efficiently manufactured and marketed.

It is a further object of the present invention to provide a new and improved horse race game apparatus which is of a durable and reliable construction.

An even further object of the present invention is to provide a new and improved horse race game apparatus which is susceptible of a low cost of manufacture with regard to both materials and labor, and which accordingly is then susceptible of low prices of sale to the consuming public, thereby making such horse race game apparatus economically available to the buying public.

Still yet another object of the present invention is to provide a new and improved horse race game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an isometric illustration of a modified starting apparatus utilized by the invention.

FIG. 11 is an orthographic view, taken along the lines 11—11 of FIG. 10 in the direction indicated by the arrows.

DESCRIPTION OF THE PREFERRED EMBODIMENT

Figure 1:
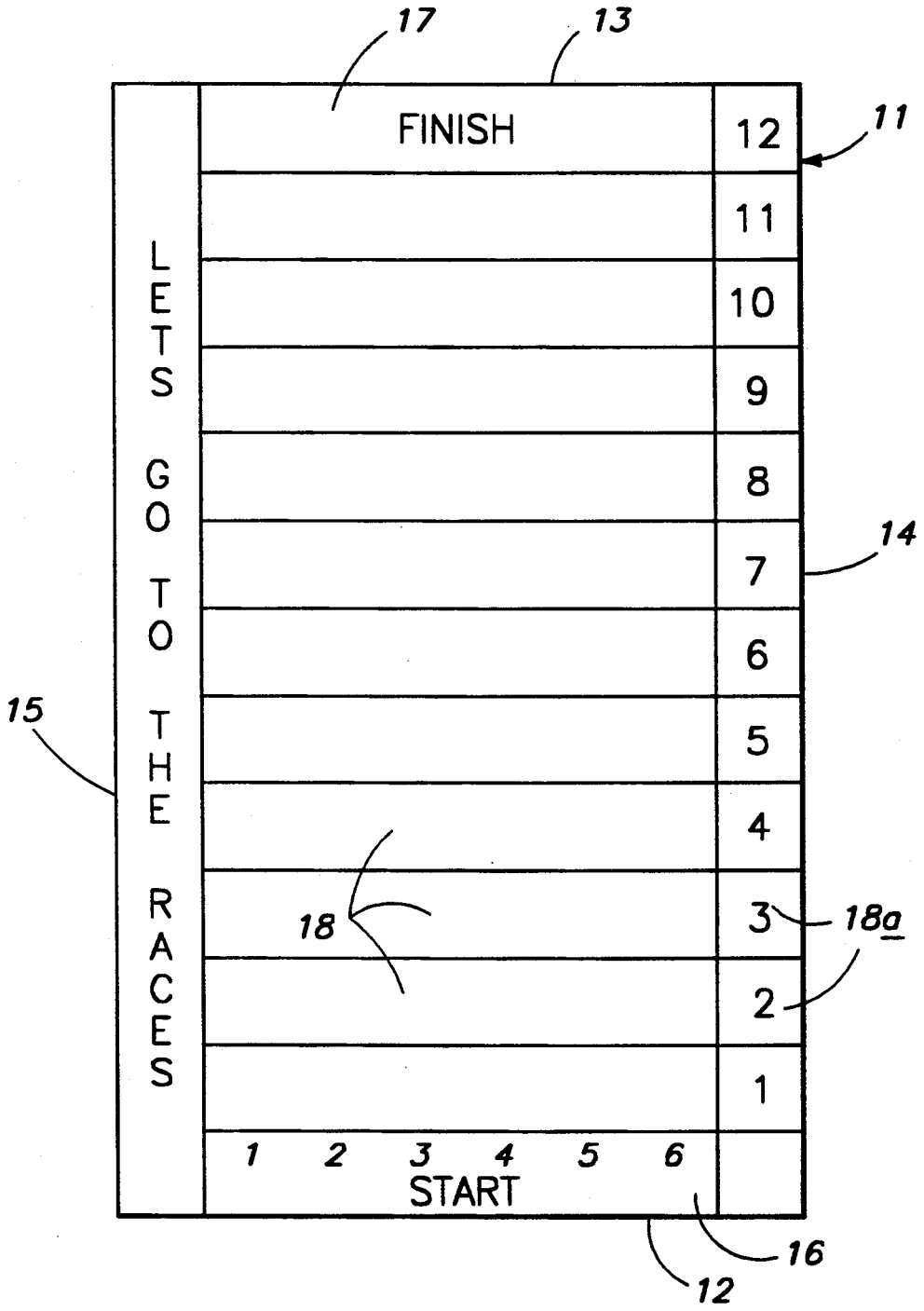
FIG. 1 is an orthographic top view of the game board of the invention.
Figure 2:
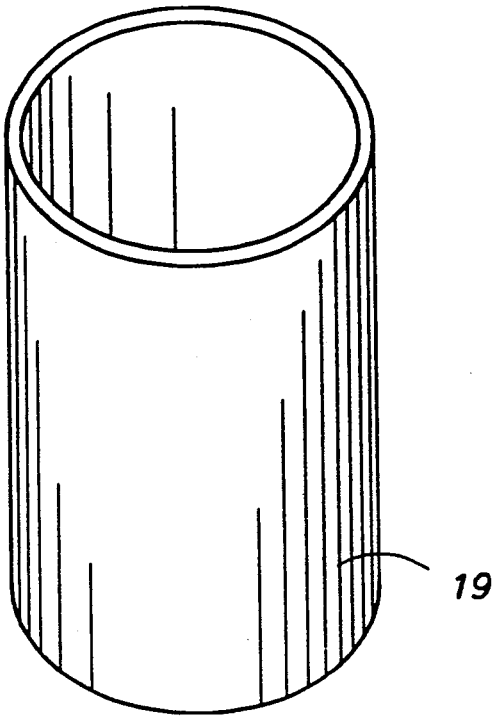
FIG. 2 is an isometric illustration of an associated dice cup utilized by the invention.
Figure 3:
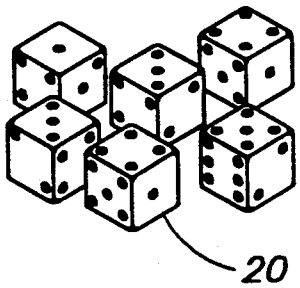
FIG. 3 is an isometric illustration of the dice members utilized by the invention.
Figure 4:
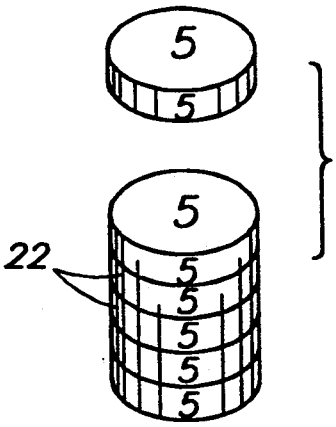
FIG. 4 is an isometric illustration of wagering chips utilized by the invention.
Figure 5:
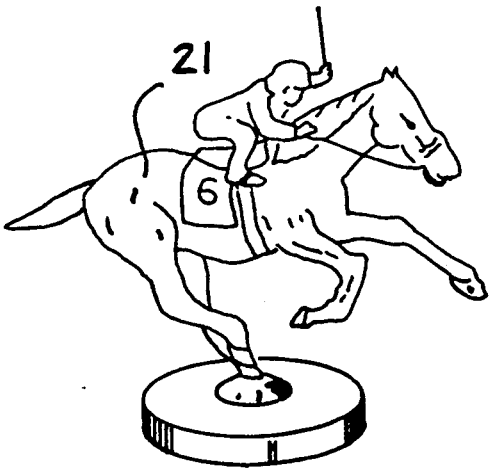
FIG. 5 is an isometric illustration of a token utilized by the invention of a plurality of such tokens.
Figure 6:
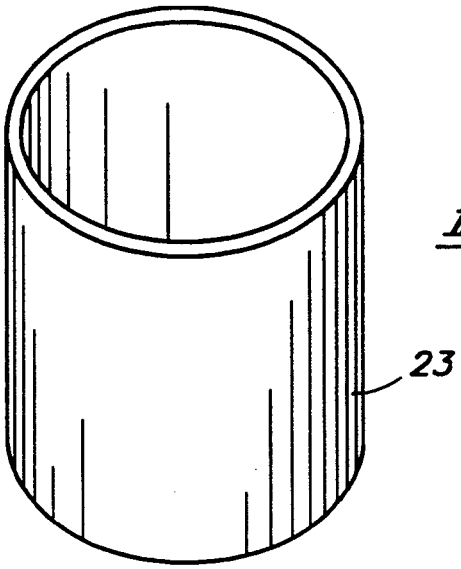
FIG. 6 is an isometric illustration of a wagering cup afforded each player in use of the invention.
Figure 7:
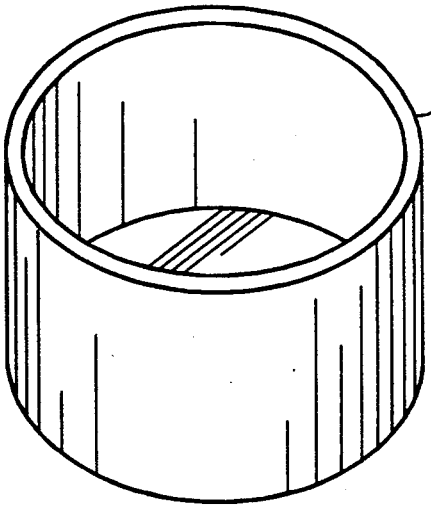
FIGS. 7 and 8 are isometric illustrations of first and second cups to contain wagering quantities therewithin.
Figure 8:
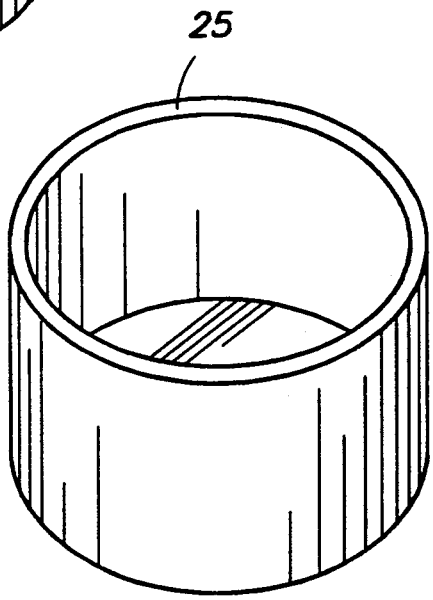
Figure 9:
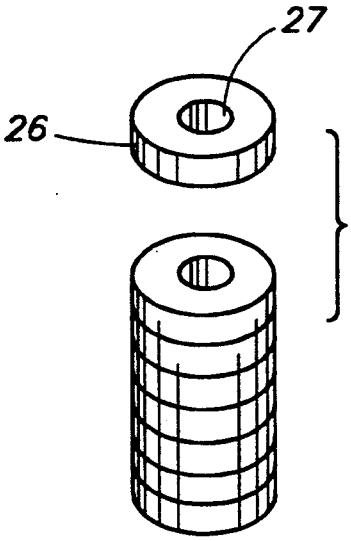
FIG. 9 is an isometric illustration of modified wagering chips utilized by the invention.

With reference now to the drawings, and in particular to FIGS. 1 to 11 thereof, a new and improved horse race game apparatus embodying the principles and concepts of the present invention and generally designated by the reference numerals 11–40 will be described.

More specifically, the horse race game apparatus of the invention includes a game board 11, including a first end wall 12 spaced from a second end wall 13 and a first side wall 14 spaced from a second side wall 15 defining a rectilinear configuration. The game board 11 includes an ending row space 17 arranged contiguously with the first end wall 12 and an ending row space 17 spaced contiguously relative to the second end wall 13. Spaced game path spaces 18 arranged in a parallel relationship between the starting row space 16 and the end row space 17, including spaces 18*a* arranged along the first side wall 14. A dice cup 19 is provided to include the shaking of a plurality of dice members 20 defined by a predetermined number substantially equal to six. The six dice members are arranged to coincide with the predetermined number of tokens 21 as six tokens. The tokens are thusly picked to provide for a token associated with each digit of the dice members, such that each dice members of the plurality of dice members 20 includes digit representations from 1–6 and accordingly six players and six tokens are thusly provided. Wagering disc cups 23 are arranged with one afforded each player to contain a plurality of wagering discs 22, with an equal number given each player of the predetermined number of players and more specifically, the six players. A respective first and second storage wagering cup 24 and 25 is provided to define a respective "winner's" cup and a "race-off winner's cup" to contain in usage of the game storage of a prize afforded a winner of a race.

OBJECT: The object of the game is to become the wealthiest player through luck and skillful wagering.

EQUIPMENT: The equipment consists of a race board, six numbered racers, a predetermined number (such as six for example) of dice, a dice cup, one winner cup, one race-off winner's cup, numbered wagering chips, six numbered token cups, and a predetermined number of different numbered racer tokens, such as six for example.

PREPARATION: Place the board on a table, on one side place the two winner's kitty cups in a row. On the opposite side of the race board place the six numbered token cups in a row and fill each cup with the respective numbered tokens. Place the six numbered racers before the start line in their respective numbered positions. Place the six dice in the dice cup and place the cup in the center of the race board. Select a banker from the players. The banker then distributes an arbitrary quantity of wagering chips such as 25 wager chips to each player. Game play is then initiated. The banker selected should be a player who is familiar with the rules of the game. If more than ten persons are playing, the banker may elect to act only as the banker for each of the races, and may select another player as an assistant banker to facilitate the banker's duties.

BANKER'S DUTIES: The banker is in charge of the game. The banker's duties include 1) Declares a time limit or specifies the number of races in the game; 2) Distribution of 25 wager chips to each player in the game; 3) Declares a value of the wager chip before the first race; 4) Maintains the race-off winner's kitty cup and distributes winnings to winners.

WAGERING: Each player chooses the racers numbered from one to six on which they want to place a wager. Each player may wager as many wager chips per number as desired, and may select to place wagers on any number of racers up to all six. For each wager chip wagered, the player extracts one token from the appropriately numbered token cup. For each numbered token the player must give the banker one wager chip. The banker places all chips wagered in the winner's cup.

STARTING A RACE: The players select the player who will roll the dice for the first race. (For the second and subsequent races of the game, the dice cup is passed to the next player on the left)

The player who rolls the dice, shakes the dice in the cup and allows the dice to spill out on the table. When the dice come to rest, the dice roller then calls out to the banker the results of the dice roll, starting with the lower numbers first, i.e., one-1, three-3's, one-4, one-6. The banker or assistant banker then moves the individual numbered racers forward toward the finish line the exact number of positions called. The same player continues rolling the dice until the race is finished.

RACE WINNER: Is determined when the first numbered racer reaches the finish line.

TIES: In the event two or more racers reach the finish line on the same roll of the dice, the one with the most calls on the dice shall be declared the winner. If there is still a tie, the dice must be rolled again until the race-off racer with the most calls on the dice is determined and declared the winner. (see FIG. 2), in this situation racers 2 and 5 tied on the finish line with the same number of calls on the dice. The dice are rolled again and reveal that the number 2 racer is the winner of the race as this racer had more calls than the number 5 racer. In this roll-off the numbers 3 and 4 do not count.

WINNING WAGERS: All players holding racer number 2 tokens are winners and share equally in the wager chips contained in the winner's cup. The banker determines from the winning players the total number of winning tokens held. The contents of the winner's cup are counted and totaled by the banker who then divides the total number of tokens into the total amount contained in the winner's cup, distributing one equal share for each token held. Any odd wager chips remaining are placed in the race-off winners kitty cup and remaining there until the last regular race of the game is completed.

RACE-OFF: After the banker declares the last regular race of the game, one final race is held and the winners holding the winning racer tokens of the race-off share equally in the amount of wager chips contained in the race-off winners cup.

No additional wagering is permitted for the race-off race. The banker determines the total number of players in the game. If there are 12 players, the banker removes two of each numbered racer tokens from the token cups and places them in the dice cup. Each player is allowed to draw one unseen token from the cup and that number becomes the player's racer for the race-off race. (In the event there are more than six players for the race-off race, but the total number is not divisible by 6, the banker selects at random which duplicate token numbers are to be used so that each player has one numbered token).

The race-off race is played the same as a regular race. The holders of the winning racer token share equally in the winnings contained in the race-off winner's cup.

GRAND WINNER: The player with the most wager chips after the race-off race.

END OF GAME: A player retires from the game when out of wager chips.

GAME VARIATIONS: Let us go to the races can be played with many variations in wagering. Win, Place, Show kitties can be established as well as Exacta and Trifecta and Quinella winnings.

The FIGS. 10 and 11 illustrate a modified starting space 16*a*. The starting space includes parallel intermediate spaced side walls 28 arranged at predetermined intervals between starting side wall 30 mounted orthogonally and integrally coextensive with the starting space 16*a* along the first side wall 14 and including a second starting side wall 31 mounted coextensively along the starting space 16*a* and the second side wall 15. Further, the plurality of starting spaces 33 is defined between the intermediate side walls 28 and the first and second starting side walls 30 and 31 to contain a token 21 therewithin. Each token 21 includes a pedestal base and a simulation representing a mounted horse, to include a horse and jockey thereon. Each token as noted is representative of each player in playing the game. Support axle 34 is pivotally mounted parallel to and coextensive with an intersection of the first starting space 16*a* and an adjacent game path space 18 spaced above the first and second starting side walls 30 and 31. A support axle lever 35 fixedly mounted to a first distal end of the axle 34 adjacent to and exteriorly of the first starting side wall 30 includes a lever lower peg 36 mounted thereon cooperative with one of a plurality of first starting side wall pegs 37. The starting side wall pegs 37 are arranged at varying distances relative to a forward edge of the first starting side wall 30. A spring 38 is directed between the lever lower peg 36 and one of the first side wall pegs 37 to provide for varying tension applied to the lever 35 and maintain the lever in a first vertical orientation, as illustrated in FIG. 10. Displacement of the lever to a second position projecting the tokens 21 from between the walls 28, 30, and 31 is provided by an axle plate 39 fixedly and orthogonally mounted relative to the axle 34 positioned between adjacent walls of the side walls 28, 30, and 31 and above an associated starting space 33. Each axle plate 29 includes an axle plate rod 40 projecting orthogonally and upwardly thereto, wherein modified torroidal wagering discs 26 are provided, with each disc including a central disc bore 27, wherein upon sufficient wagering represented by the discs 26 placed upon the rods 40, the weight will thusly direct the axle plates 39 downwardly to project the tokens 21 forwardly of the starting spaces 33 as the axle plates 39 are of a predetermined length substantially equal to a predetermined height defined by the first and second starting side walls 30 and 31. Spring tension directed to the spring 38 may be varied by positioning the spring 38 at various of the starting first side wall pegs 37 to modify the amount of discs 26 required to be positioned on the rods 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A horse race game apparatus, comprising, a game board, the game board including a first end wall, a second end wall, a first side wall, and a second side wall defining a generally rectilinear configuration, with a starting row space arranged contiguously along the first end wall on a top surface of the game board, with an ending row space arranged contiguously with the second end wall on the top surface of the game board, and spaced parallel game path spaces directed between the starting row space and the ending row space, and a predetermined number of dice members, and a dice cup arranged for reception of the dice members, and a plurality of tokens equal to the predetermined number, and a plurality of wagering discs, and each of the tokens afforded a number from one to the predetermined number, and each dice member including a digital representation on the dice member from one to the predetermined number, whereupon directing of the dice members from the dice cup, the tokens are moved forwardly when a dice member indicates a digital representation in association with a token, and the starting row space is demarcated into a plurality of starting spaces equal to the predetermined number, and wherein the starting row space includes a starting space first starting side wall contiguously joined to the first side wall coextensive with the starting row space oriented orthogonally relative to the game board top surface, and a second starting side wall parallel to the first starting side wall arranged contiguously with the second side wall coextensive with the starting row space, wherein the first starting side wall and the second starting side wall are of a predetermined height, and the starting row space includes a plurality of intermediate side walls orthogonally oriented to the game board top surface between the first starting side wall and the second starting side wall and parallel to the first starting side wall and the second starting side wall coextensive therewith to define the plurality of starting spaces in the starting row space, and a support axle pivotally mounted parallel to the game board top surface mounted orthogonally to the first starting side wall and the second starting side wall and positioned above an intersection defined by the starting row space and an adjacent game path space of said plurality of game path spaces, and a starting axle lever fixedly mounted to a first distal end of the support axle, the starting lever positioned adjacent to and exteriorly of the first starting side wall, wherein the starting axle lever includes a lever lower peg mounted adjacent a lower distal end of the support axle lever, and the first starting side wall includes a plurality of first starting side wall pegs, and each of the first starting side wall pegs is positioned at varying positions relative to the support axle, and a spring mounted between the lever lower peg and one of the plurality of first starting side wall pegs, and a plurality of axle plates, each axle plate mounted orthogonally relative to the starting axle and extending over a starting space of said plurality of starting spaces, and each axle plate defined by a predetermined height equal to the predetermined height of the first starting side wall and the second starting side wall, and each axle plate including a plate rod orthogonally mounted to said axle plate and wherein each wagering disc includes a wagering disc bore directed therethrough permitting each wagering disc to be positioned onto one of said axle plate rods.

* * * * *